US007152591B1

(12) United States Patent
Maeda et al.

(10) Patent No.: US 7,152,591 B1
(45) Date of Patent: Dec. 26, 2006

(54) IGNITION APPARATUS FOR AN INTERNAL COMBUSTION ENGINE

(75) Inventors: Masayoshi Maeda, Hyogo (JP); Takeshi Shimizu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/434,895

(22) Filed: May 17, 2006

(30) Foreign Application Priority Data

Jan. 25, 2006 (JP) ..... 2006-016489

(51) Int. Cl.
*F02P 11/00* (2006.01)

(52) U.S. Cl. ..... 123/633; 123/634

(58) Field of Classification Search ..... 123/594, 123/633, 634
See application file for complete search history.

(56) References Cited

U.S. PATENT DOCUMENTS 6,463,918 B1 * 10/2002 Moga et al. ..... 123/633
2002/0046746 A1 * 4/2002 Nakabayashi et al. ..... 123/634
2004/0084036 A1 * 5/2004 Porter et al. ..... 123/634
2004/0231652 A1 * 11/2004 Kondo et al. ..... 123/634

FOREIGN PATENT DOCUMENTS

JP 2002-081360 A 3/2002

* cited by examiner

*Primary Examiner*—Erick R Solis
(74) *Attorney, Agent, or Firm*—Sughrue Mion, PLLC

(57) ABSTRACT

An ignition apparatus for an internal combustion engine can suppress radiation noise radiated into air from a discharge current path, thereby preventing the malfunction of electrical equipment mounted on a vehicle. The ignition apparatus includes a transformer having a primary winding and a secondary winding, a conductor for impressing a high voltage generated at a high voltage side of the secondary winding upon interruption of a primary current to the primary winding to a spark plug, a plug boot enclosing the conductor so as to electrically insulate it from the outside and to hold the spark plug, and a metal sleeve arranged to enclose the plug boot and having one end thereof electrically connected directly or indirectly to a low voltage side of the secondary winding, and the other end thereof electrically connected directly or indirectly to the spark plug.

4 Claims, 3 Drawing Sheets

IGNITION APPARATUS FOR AN INTERNAL COMBUSTION ENGINE

FIELD OF THE INVENTION

The present invention relates to an ignition apparatus for an internal combustion engine which supplies a high voltage to a spark plug for each engine cylinder

DESCRIPTION OF THE RELATED ART

In the past, there have been known ignition apparatuses for an internal combustion engine which include a transformer having a primary winding and a secondary winding, a conductor for impressing a high voltage, which is generated at a high voltage side of the secondary winding when a primary current to the primary winding is interrupted, to a spark plug, and a plug boot that encloses the conductor so as to electrically insulate it from the outside and to hold the spark plug.

In a negative electrode discharge type ignition apparatus among such ignition apparatuses for an internal combustion engine, a discharge current containing high frequency noise generated upon electric discharge in a gap between electrodes of the spark plug is returned to the spark plug received in a plug hole in a cylinder head through the secondary winding, the connector, a vehicle body harness, a cam cover, and the cylinder head.

Here, as a relevant prior art reference, there is cited a patent document (Japanese patent application laid-open No. 2002-81360).

In this case, however, there is a problem that the noise generated upon electric discharge of the spark plug is radiated into air through the body harness, electrical equipment mounted on a vehicle is caused to malfunction due to this noise.

SUMMARY OF THE INVENTION

Accordingly, the present invention is intended to obviate the problem as referred to above, and has for its object to obtain an ignition apparatus for an internal combustion engine which is capable of suppressing radiation noise radiated into air from a discharge current path thereby to prevent the malfunction of electric equipment mounted on a vehicle.

Bearing the above object in mind, according to the present invention, there is provided an ignition apparatus for an internal combustion engine which includes: a transformer having a primary winding and a secondary winding; a conductor that impresses a high voltage, which is generated at a high voltage side of the secondary winding when a primary current to the primary winding is interrupted, to a spark plug; a plug boot that encloses the conductor so as to electrically insulate it from the outside and to hold the spark plug; and a metal sleeve that is arranged to enclose the plug boot and has one end thereof electrically connected directly or indirectly to a low voltage side of the secondary winding, and the other end thereof electrically connected directly or indirectly to the spark plug.

According to the ignition apparatus for an internal combustion engine of the present invention, radiation noise radiated into air from the discharge current path can be suppressed, thereby making it possible to prevent the malfunction of electrical equipment mounted on a vehicle.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
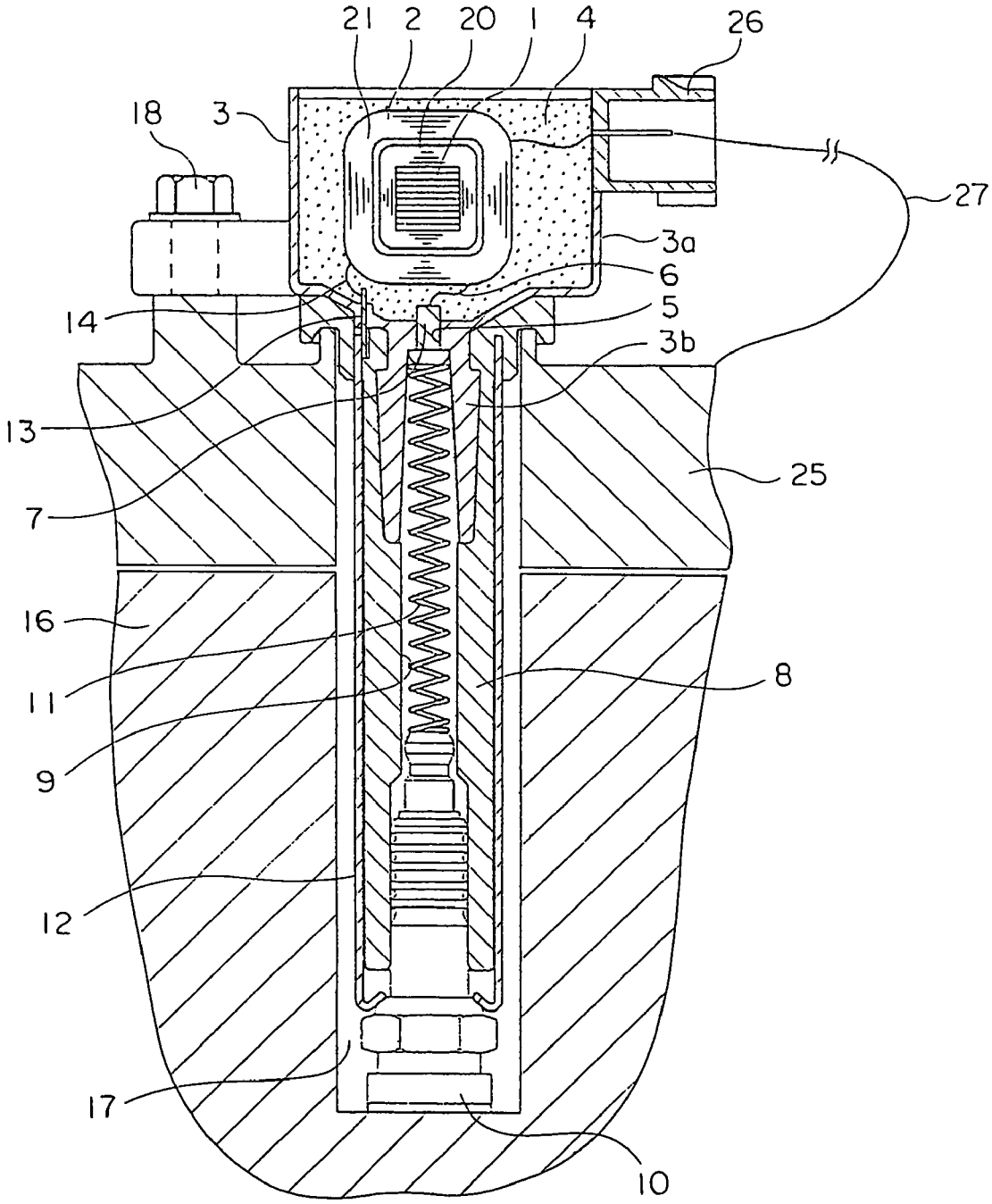
FIG. 1 is a cross sectional view showing an ignition apparatus for an internal combustion engine according to a first embodiment of the present invention.

Now, preferred embodiments of the present invention will be described in detail while referring to the accompanying drawings. Throughout respective figures, the same or corresponding members or parts are identified by the same reference numerals and characters.

Embodiment 1

FIG. 1 is a cross sectional view that shows an ignition apparatus for an internal combustion engine according to a first embodiment of the present invention. The ignition apparatus for an internal combustion engine illustrated in FIG. 1 is an ignition apparatus of the negative electrode discharge type with a transformer 2 being received in a case 3. The transformer 2 has an iron core 1 that is formed of a plurality of pieces of thin sheet steel, and a primary winding 20 and a secondary winding 21 that are wound around the iron core 1. The case 3 is composed of a case main body 3*a* that receives the transformer 2 insulated and fixedly attached thereto by a cast insulating resin 4, and a high voltage tower 3*b* that is formed integrally with the case main body 3*a* and has an opening portion 5 placed in communication with the case main body 3*a*.

In the opening portion 5 of the high voltage tower 3*b*, a connector terminal 7 is electrically connected to a high voltage side connecting wire 6 of the secondary winding 21 in a manner to close the opening portion 5.

A plug boot 8 made of rubber is fitted onto a high voltage tower 3*b* of the case 3. The plug boot 8 is formed with a through hole 9 along the central axis thereof. A spring 11, being a conductor electrically connected to a spark plug 10, is arranged in the interior of the high voltage tower 3*b* and in the through hole 9 so as to urge the ignition plug 10 in a direction away from the high voltage tower 3*b* and the plug boot 8. A metal sleeve 12 is arranged on the outer periphery of the plug boot 8, and has its one end connected to a low voltage side connecting wire 14 of the secondary winding 21 through a low voltage connector terminal 13, and its other end connected to the spark plug 10.

This ignition apparatus for an internal combustion engine is fixed attached to a cam cover 25 by means of a bolt 18 with the plug boot 8 being inserted into a plug hole 17. At this time, the spring 11 presses, at its one or tip end, one end face of the spark plug 10.

In the ignition apparatus for an internal combustion engine of the negative electrode discharge type, for example, a high voltage of −30 kV is impressed to the high voltage connector terminal 7, and a discharge current containing high frequency noise generated in the gap portion of the spark plug 10 is returned to the spark plug 10 mainly through the spring 11, the high voltage connector terminal 7 of the secondary winding 21, the low voltage side connecting wire 14, the low voltage connector terminal 13, and the metal sleeve 12. That is, there is substantially no possibility that the discharge current is returned to the spark plug 10 through a high resistance path comprising a connector 26, the body harness 27, the cam cover 25 and the cylinder head 16, but instead the discharge current is returned to the spark plug 10 mainly through an electric path formed at the side of the metal sleeve 12.

Thus, according to this ignition apparatus for an internal combustion engine, the discharge current including noise is returned mainly through a minimum path including the metal sleeve 12, so the radiation of noise into air can be suppressed to a minimum, and the malfunction of electrical equipment mounted on a vehicle due to noise can also be suppressed.

Embodiment 2

Figure 2:
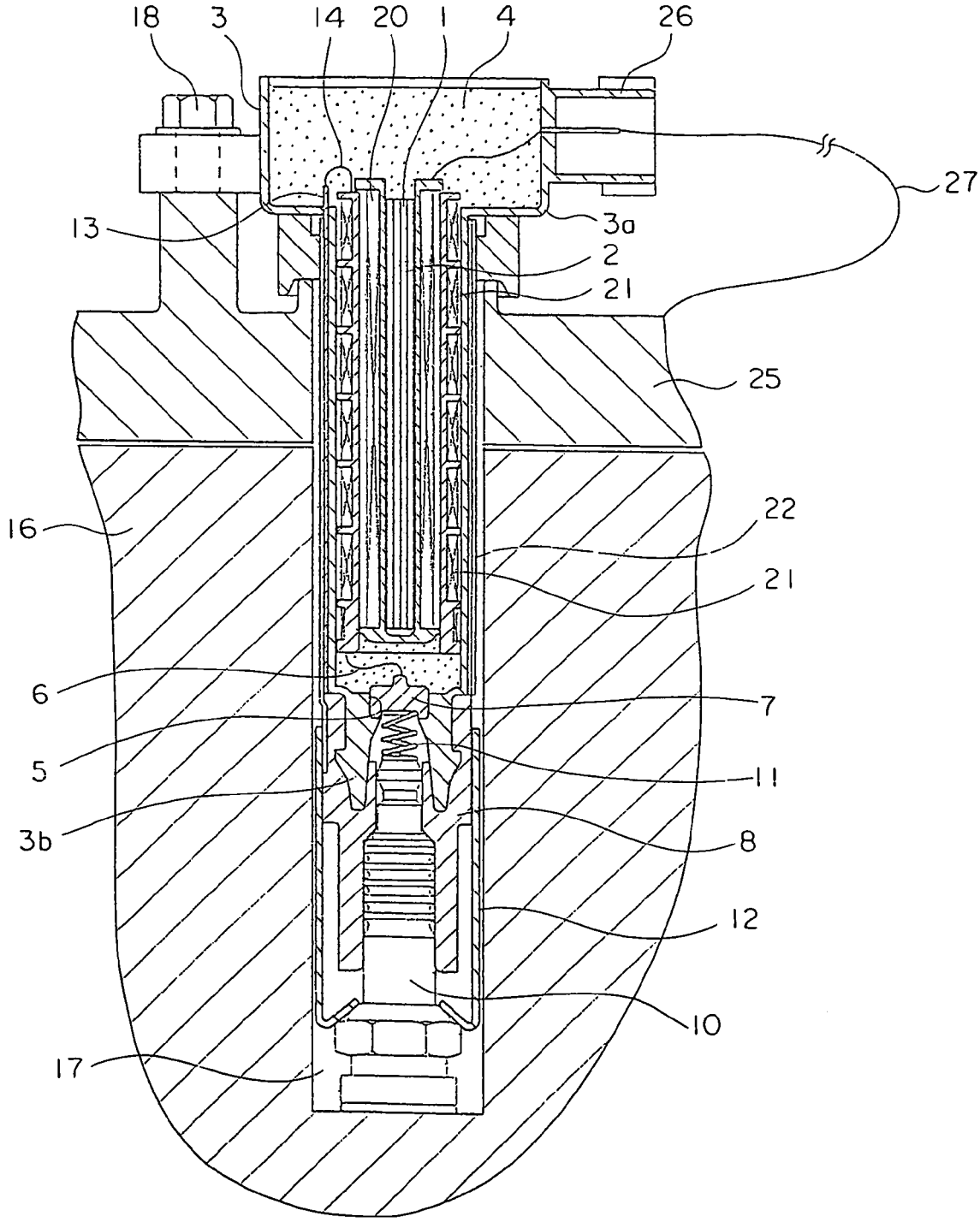
FIG. 2 is a cross sectional view showing an ignition apparatus for an internal combustion engine according to a second embodiment of the present invention.

FIG. 2 is a cross sectional view that shows an ignition apparatus for an internal combustion engine according to a second embodiment of the present invention.

In this embodiment, a transformer 2 is arranged in a plug hole 17, and is composed of an iron core 1 formed of pieces of laminated thin sheet plates, a primary winding 20 surrounding the iron core 1, and a secondary winding 21 surrounding the primary winding 20, with the outer periphery of the transformer 2 being enclosed by a case main body 3*a*. On the outer peripheral surface of the case main body 3*a*, there is arranged an exterior iron core 22 that forms a path through which passes a magnetic flux generated when a primary current is supplied to the primary winding 20. The exterior iron core 22 has its one end connected to a low voltage side connecting wire 14 of the secondary winding 21 through a low voltage connector terminal 13, and has its other end electrically connected to a metal sleeve 12 of a cylindrical shape. The metal sleeve 12 connected at its one end to the exterior iron core 22 is connected at its other end to a spark plug 10.

The construction of this second embodiment other than the above is similar to that of the first embodiment.

According to the ignition apparatus for an internal combustion engine of this second embodiment, a discharge current containing high frequency noise generated in a gap portion of the spark plug 10 is returned to the spark plug 10 mainly through the spring 11, the high voltage connector terminal 7 of the secondary winding 21, the low voltage side connecting wire 14, the low voltage connector terminal 13, the exterior iron core 22, and the metal sleeve 12.

Thus, in the ignition apparatus for an internal combustion engine having the exterior iron core 22, the radiation of noise into air can be suppressed to a minimum, and the malfunction of vehicle-mounted electrical equipment due to the noise can also be suppressed, as in the above-mentioned first embodiment. Moreover, the exterior iron core 22 together with the metal sleeve 12 functions as a passage for the discharge current, so the length of the metal sleeve 12 can be shortened, thereby making it possible to reduce the production cost.

Embodiment 3

Figure 3:
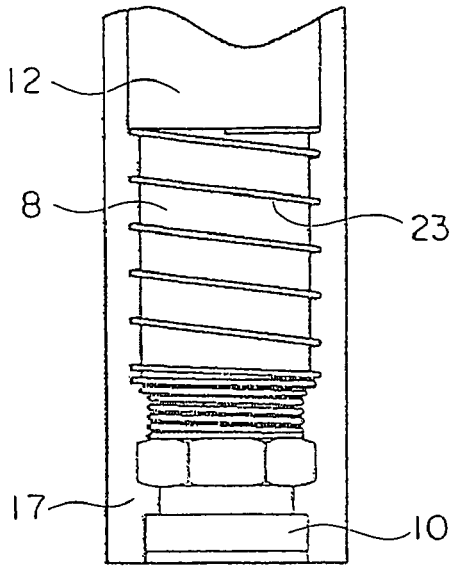
FIG. 3 is a cross sectional view showing an ignition apparatus for an internal combustion engine according to a third embodiment of the present invention.

FIG. 3 is a cross sectional view that shows an ignition apparatus for an internal combustion engine according to a third embodiment of the present invention.

In the ignition apparatus for an internal combustion engine of this embodiment, between an end of the metal sleeve 12 and an end of the spark plug 10, there is arranged a coil spring 23 that encloses the plug boot 8 and is at the same time in contact with the spark plug 10.

The construction of this third embodiment other than the above is similar to that of the first embodiment.

According to the ignition apparatus for an internal combustion engine of this third embodiment, advantageous effects similar to those of the first embodiment can be achieved. In addition, the metal sleeve 12 and the spark plug 10 are electrically connected to each other through the coil spring 23 in a reliable manner, so it is possible to prevent the occurrence of noise due to an electric discharge which would otherwise be generated between the metal sleeve 12 and the spark plug 10 that are spaced from each other.

Embodiment 4

Figure 4:
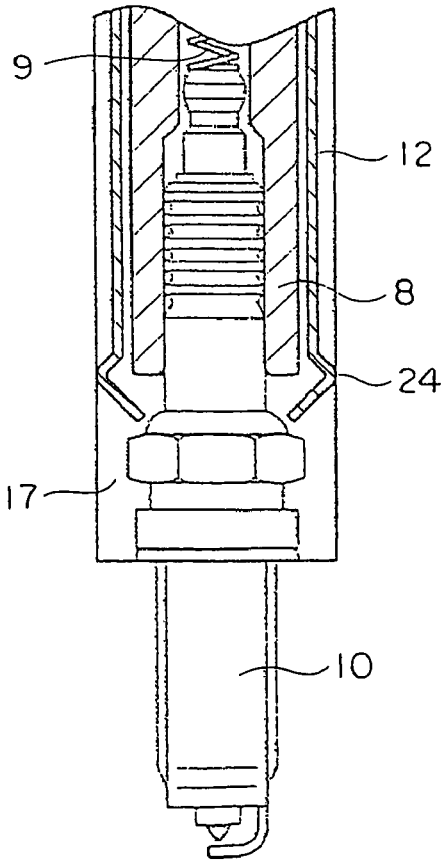
FIG. 4 is a cross sectional view showing an ignition apparatus for an internal combustion engine according to a fourth embodiment of the present invention.

FIG. 4 is a cross sectional view that shows an ignition apparatus for an internal combustion engine according to a fourth embodiment of the present invention.

In this embodiment, the metal sleeve 12 is formed at its end near the spark plug 10 with an enlarged portion 24 that expands in a diametral direction, the enlarged portion 24 being in resilient contact with an inner wall surface of the plug hole 17 that receives the spark plug 10.

The construction of this fourth embodiment other than the above is similar to that of the first embodiment.

According to the ignition apparatus for an internal combustion engine of this fourth embodiment, a discharge current containing high frequency noise generated in the gap portion of the spark plug 10 is returned to the spark plug 10 mainly through the spring 11, the high voltage connector terminal 7 of the secondary winding 21, the low voltage side connecting wire 14, the low voltage connector terminal 13, the enlarged portion 24 of the metal sleeve 12, and the inner wall surface of the plug hole 17.

According to the ignition apparatus for an internal combustion engine of this fourth embodiment, advantageous effects similar to those of the first embodiment can be achieved, and in addition, the enlarged portion 24 of the metal sleeve 12 has a function as a center locator when the ignition apparatus for an internal combustion engine is inserted into the plug hole 17, so that upon insertion of the ignition apparatus into the plug hole 17, the enlarged portion 24 of the metal sleeve 12 is inserted into the plug hole 17 while being in contact with the inner wall surface of the plug hole 17, as a result of which the ignition apparatus can be smoothly inserted into the plug boot 8.

Moreover, the metal sleeve 12 and the spark plug 10 are electrically connected to each other through the inner wall surface of the plug hole 17 in a reliable manner, so it is possible to prevent the occurrence of noise due to an electric discharge which would otherwise be generated between the metal sleeve 12 and the spark plug 10 that are spaced from each other.

Although in the above-mentioned respective embodiments, reference has been made to the ignition apparatuses of the negative electrode discharge type for an internal combustion engine in which a high negative voltage is impressed to the high voltage connector terminal 7, the present invention can of course be applied to an ignition apparatus of the positive electrode discharge type for an internal combustion engine in which a high positive voltage is impressed to a high voltage connector terminal.

In this case, the ignition apparatus of the positive electrode discharge type is identical in the path for a discharge current with, but is opposite in the direction of flow to, the ignition apparatus of the negative electrode discharge type.

While the invention has been described in terms of preferred embodiments, those skilled in the art will recognize that the invention can be practiced with modifications within the spirit and scope of the appended claims.

What is claimed is:

1. An ignition apparatus for an internal combustion engine comprising:

a transformer having a primary winding and a secondary winding;

a conductor that impresses a high voltage, which is generated at a high voltage side of said secondary winding when a primary current to said primary winding is interrupted, to a spark plug;

a plug boot that encloses said conductor so as to electrically insulate it from the outside and to hold said spark plug; and a metal sleeve that is arranged to enclose said plug boot and has one end thereof electrically connected directly or indirectly to a low voltage side of said secondary winding, and the other end thereof electrically connected directly or indirectly to said spark plug.

2. The ignition apparatus for an internal combustion engine as set forth in claim 1, further comprising an exterior iron core that is arranged so as to enclose said transformer and form a passage for a magnetic flux generated when a primary current is supplied to said primary winding, wherein said exterior iron core has one end thereof electrically connected to the low voltage side of said secondary winding, and the other end thereof electrically connected to said metal sleeve.

3. The ignition apparatus for an internal combustion engine as set forth in claim 1, further comprising a coil spring that is arranged between an end of said metal sleeve and an end of said spark plug so as to enclose said plug boot and contact said spark plug.

4. The ignition apparatus for an internal combustion engine as set forth in claim 1, wherein said metal sleeve is formed at an end thereof near said spark plug with an enlarged portion that expands in a diametral direction, and said enlarged portion is in resilient contact with an inner wall surface of said plug hole that receives said spark plug.

* * * * *